United States Patent [19]

Brux

[11] Patent Number: 4,576,675

[45] Date of Patent: Mar. 18, 1986

[54] SYSTEM FOR SECURING A PLURALITY OF OBJECTS TOGETHER WITH ADHESIVE TAPE

[75] Inventor: Robert A. Brux, Salinas, Calif.

[73] Assignee: Crown Zellerbach Corporation, San Francisco, Calif.

[21] Appl. No.: 640,423

[22] Filed: Aug. 13, 1984

[51] Int. Cl.[4] ..... B32B 31/04; B65B 11/48; B65B 13/02; B65B 27/10

[52] U.S. Cl. ..... 156/468; 53/586; 53/590; 156/196; 156/212; 156/213; 156/475; 156/486; 156/492; 156/507; 156/512

[58] Field of Search ..... 156/507, 512, 522, 468, 156/475, 486, 492, 196, 212, 213; 53/586, 590, 592

[56] References Cited

U.S. PATENT DOCUMENTS

| | | | |
|---|---|---|---|
| 1,861,144 | 5/1932 | Schmiedel | 156/468 |
| 2,780,044 | 2/1957 | Dewyer | 53/590 |
| 2,788,625 | 4/1957 | Larsen et al. | 53/590 |
| 3,823,528 | 7/1974 | Janssen | 53/586 |

*Primary Examiner*—Caleb Weston
*Attorney, Agent, or Firm*—Thomas R. Lampe

[57] ABSTRACT

A system for wrapping a plurality of objects with an adhesive tape including yieldable support flaps for applying the tape and delivery means for periodically delivering a predetermined length tape to the flaps.

1 Claim, 4 Drawing Figures

SYSTEM FOR SECURING A PLURALITY OF OBJECTS TOGETHER WITH ADHESIVE TAPE

BACKGROUND OF INVENTION

This invention relates to an apparatus and method for securing a plurality of objects together with an adhesive tape. The system has application to any working environment wherein it is desired to secure a plurality of objects together, but has particular application to the securing together of farm produce sold in bunches such as carrots, celery, broccoli, etc.

The most commonly used expedient for securing together objects of the aforedescribed nature are twist ties, rubber bands, plastic bunching rings and string ties. Use of these items often requires considerable manual manipulation and expenditure of time with attendant high cost. While devices have been devised to secure twist ties, rubber bands and the like about objects, such equipment is characterized by its relative complexity and high expense. Then too, some of the devices do not perform reliably.

BRIEF SUMMARY OF THE INVENTION

According to the teachings of the present invention, an arrangement is provided to secure a plurality of objects such as farm produce together with an adhesive tape. The apparatus of the present invention includes an adhesive tape supply means including a roll of adhesive tape having a free end. A securing station is disposed adjacent to the tape supply means and includes securing means for securing a predetermined length of tape about a plurality of objects positioned at the securing station. Delivery means is provided for periodically delivering a predetermined length of tape to the securing station. The delivery means includes a gripper means and prime mover means for moving the gripper means between a first position whereat the gripper means grips the free end of adhesive tape projecting from the roll of adhesive to a second position at which a predetermined length of tape is positioned at the securing station. The predetermined length of tape is automatically separated from the roll of adhesive and the operator places the plurality of objects in engagement with the length of tape and forces the objects and tape downwardly through flaps located at the securing station. The flaps engage the objects to wrap the tape around them and secure it thereto.

DETAILED DESCRIPTION

Figure 2:
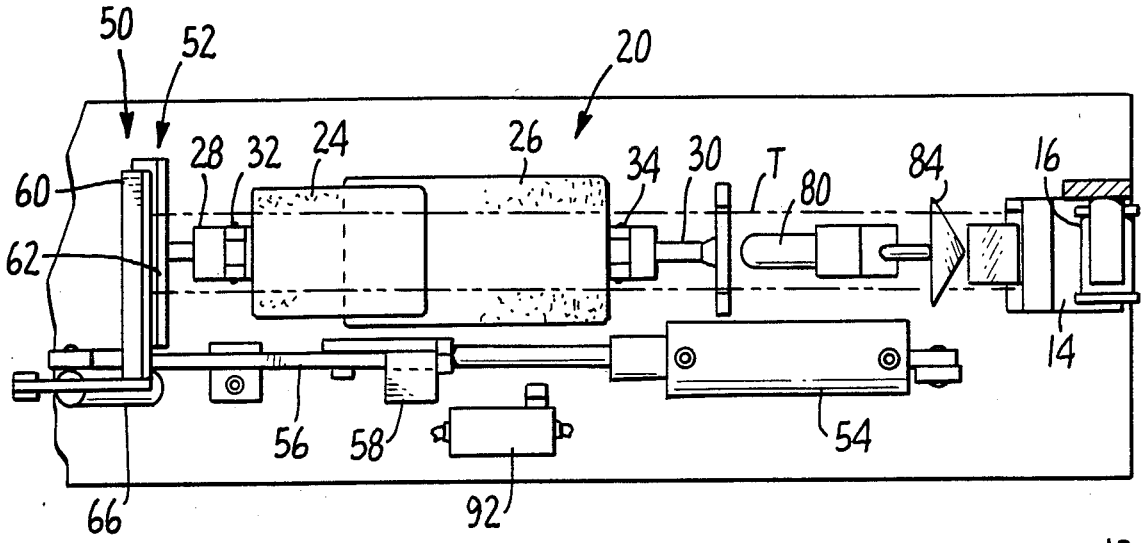
FIG. 2 is a plan view of the apparatus of FIG. 1.

Referring now to the drawings, a preferred form of apparatus constructed in accordance with the teachings of the present invention is illustrated. The apparatus includes adhesive tape supply means 10 including a roll of adhesive tape 12 having a free end. Only a portion of the roll 12 is illustrated (see FIG. 1) and it will be understood that the roll is mounted for rotational movement on any suitable support arrangement operatively associated with the apparatus. The free end of the adhesive tape T is normally disposed on a plate 14 also comprising a portion of the adhesive tape supply means 10. A portion of the tape normally extends slightly beyond the plate. In the practice of the present invention the adhesive tape is conventionally adhesive only on one side thereof and that adhesive side is disposed upwardly as the tape is positioned on plate 14. The tape as it extends from roll 12 to the plate 14 is in contact with a portion of a roller 16 which is freely rotatable in the clockwise direction as viewed in FIG. 1, but is prevented by a pawl mechanism 18 from rotating counterclockwise. In this manner, tape positioned on plate 14 will not slide off the surface thereof and will always remain in position for subsequent delivery to the securing station of the present apparatus in a manner which will now be described.

Spaced from adhesive tape supply means 10 is a securing station 20 which includes securing means for securing a predetermined length of tape about a plurality of objects positioned at the securing station. The securing means is in the form of a first flap 24 and a second flap 26, said flaps being pivotally mounted on mounting posts 28 and 30. The pivotal connection between first flap 24 and mounting post 28 is provided by a spring-biased hinge 32 which serves to yieldably retain first flap 24 in the horizontal position illustrated in FIG. 1. Second flap 26 is pivotally connected to mounting post 30 by a spring-biased hinge 34 which likewise serves to maintain second flap 26 in the horizontal position illustrated in FIG. 1. When said flaps are in the illustrated position they are partially superposed with respect to one another, i.e., a portion of second flap 26 is disposed under first flap 24. As will be seen, the flaps cooperate to provide support for a predetermined length of tape and are yieldably displaced when a plurality of objects is placed in engagement therewith to conform to the outer surface of the objects and press the predetermined length of tape into adhesive engagement therewith.

The flaps 24 and 26 are formed of a yieldable material such as rubber ply material. First flap 24 comprises only one straight flap segment. Second flap 26, on the other hand, is generally L-shaped and comprises an inner flap portion 38 and a dependent outer flap portion 40 secured to the inner flap portion by a bracket 42.

Delivery means 50 is provided for periodically delivering a predetermined length of tape to securing station 20 from tape supply means 10. The delivery means 50 includes a gripper means 52 and a prime mover for moving the gripper means between the solid and broken line positions illustrated in FIG. 1 in the form of a pneumatic cylinder 54. Gripper means 52 includes an elongated arm 56 pivotally mounted at its lower end and connected to the piston arm 58 operatively associated with pneumatic cylinder 54. At the upper or outer end of elongated arm 56 is pivotally mounted a jaw element 60. A second jaw element 62 is positioned below jaw element 60 and fixedly attached to elongated arm 56. A piston arm 64 operatively associated with pneumatic cylinder 66 is connected to the end of jaw element 60 disposed opposite to second jaw element 62 whereby outward movement of piston arm 64 will cause jaw elements 60 and 62 to clamp whatever is disposed therebetween. On the other hand, the retraction of piston arm 64 results in the jaw elements moving apart and release of whatever has been secured therebetween.

The sequence of operation of the apparatus will now be described. The entire operation is carried out by the pneumatic control system schematically set forth in FIG. 4. The condition of the pneumatic control system will first be described when the delivery means is in the position illustrated in FIGS. 1 and 4, that is, when the elongated arm is canted to the left in its extreme counterclockwise position.

Figure 4:
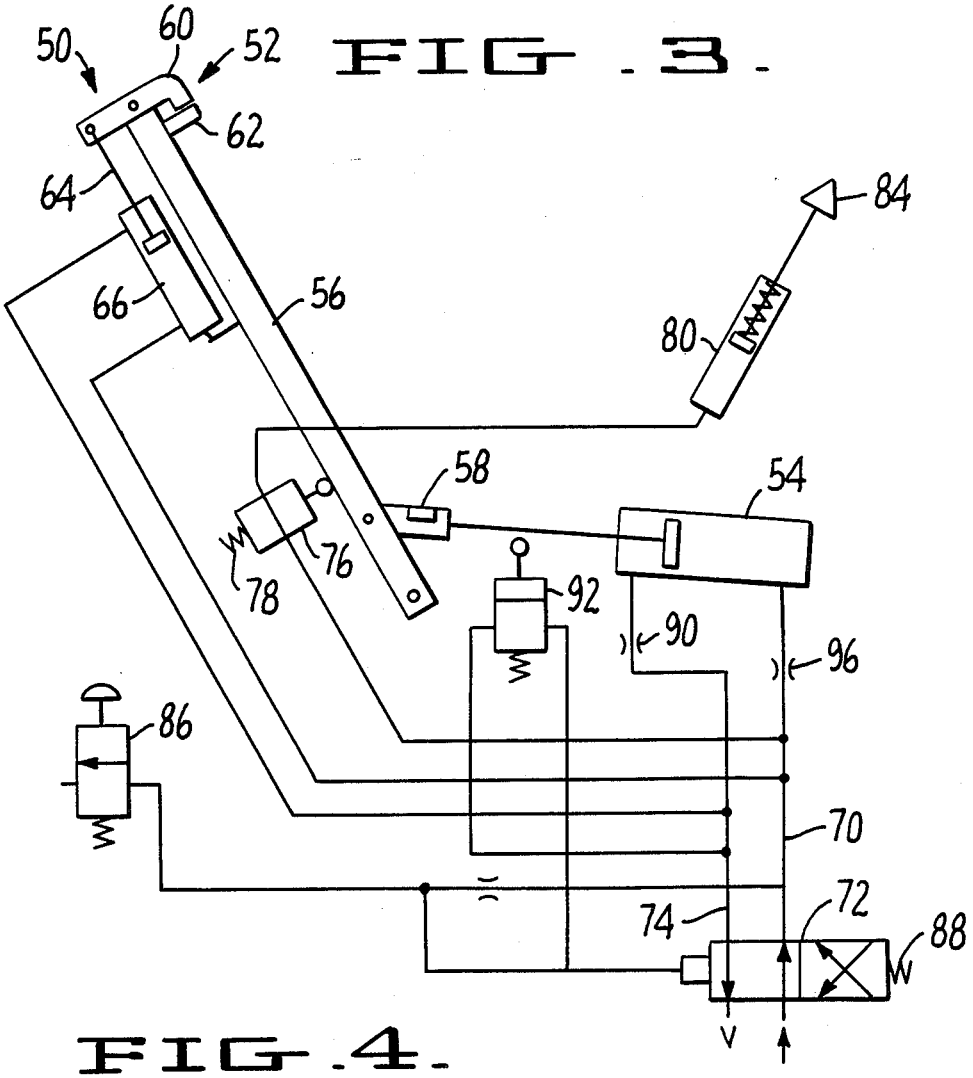
FIG. 4 is a schematic presentation of the pneumatic control system utilized in the apparatus of FIGS. 1–3.

In said initial position air pressure is applied to line 70 through main valve 72 from a suitable source of pressurized air (not shown). In the valve position illustrated in FIG. 4, line 74 vents to the ambient atmosphere through main valve 72. Feeder lines proceeding from line 70 maintain piston arm 58 and piston arm 64 in fully extended position, thus causing jaw element 60 to clamp with jaw element 62 and elongated arm 56 to be located in the position illustrated in FIGS. 1 and 4. It will be noted that when arm 56 is in this position it engages a switch valve 76 and opens said valve against the urging of a coil spring 78 normally biasing the switch valve 76 to closed position. Thus, pressurized air passes through switch valve 76 into a line connected to a third pneumatic cylinder 80. The piston within cylinder 80 is operatively associated with a knife 84 which is adapted to sever a predetermined length of adhesive tape from the main supply thereof in manner which will be described in greater detail below. Knife 84 is shown in FIGS. 1 and 4 in its fully extended position.

The operator actuates the apparatus by pushing operating switch 86. This vents the pilot of main valve 72 and spring 88 operatively associated with said main valve urges the valving element to the left thus pressuring line 74 and venting line 70. Cylinder 80 will now be vented to cause retraction of the knife 84 by the internal spring associated with the cylinder 80 and the piston thereof. The piston operatively associated with cylinder 66 will also retract to pivot jaw element 60 and release clamping engagement between that element and second jaw element 62.

The piston in cylinder 54 will also retract due to the reversal of the pressure and vent lines operatively associated with that cylinder. This will cause arm 56 to move clockwise to the dotted line position shown in FIG. 1. Preferably, a restrictor 90 is disposed in operative association with line 74 to control arm speed. As arm 56 makes such movement the arm will withdraw from contact with switch valve 76 and spring 78 will cause said switch valve to move to a position whereat pressure is released from cylinder 80. This will maintain knife 84 in retracted position.

Figure 1:
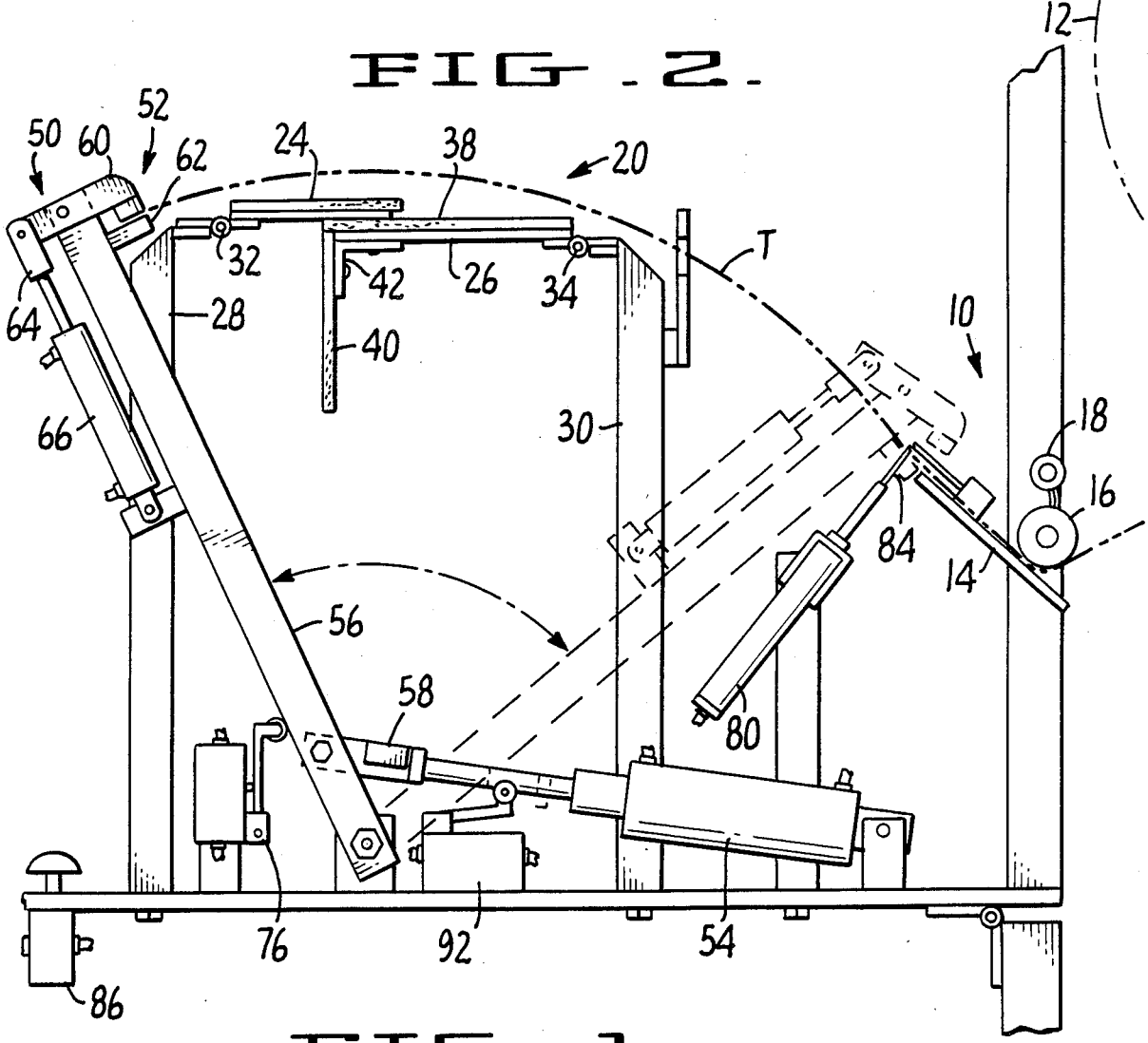
FIG. 1 is a side view of a preferred form of apparatus constructed in accordance with the teachings of the present invention.

When arm 56 reaches the broken line position illustrated in FIG. 1, the enlarged end of piston arm 58 will actuate pneumatic switch 92 by depressing the control element thereof. This will serve to apply pressure from line 74 to the pilot of main valve 72, thus reversing the main valve against the compressive forces of spring 88. Air pressure will now be on line 70 and line 74 will vent. The piston 66 will be pressurized below its associated piston and piston arm 64 will extend to bring jaw elements 60 and 62 together into clamping relationship. The end of tape from roll 20 is normally located in alignment with knife 84 and extends beyond plate 14 so that the end will now be clamped between the jaw elements.

Repressurization of line 70 now causes piston arm 58 to extend and elongated arm 56 to translate in a counterclockwise direction. A restrictor 96 is preferable provided to reduce speed of arm translation. Since the end of the tape is clamped by jaw elements 60 and 62 a predetermined length of the tape is pulled over securing station 20 and into position on flaps 24 and 26. At the end of its travel, arm 56 opens switch valve 76. This repressurizes cylinder 80 and knife 84 is extended to sever the removed predetermined length of tape from the tape supply. The free end of the tape will extend beyond platform 14 ready for grasping by jaw elements 60 and 62 whenever the apparatus is reactivated by the operator.

Figure 3:
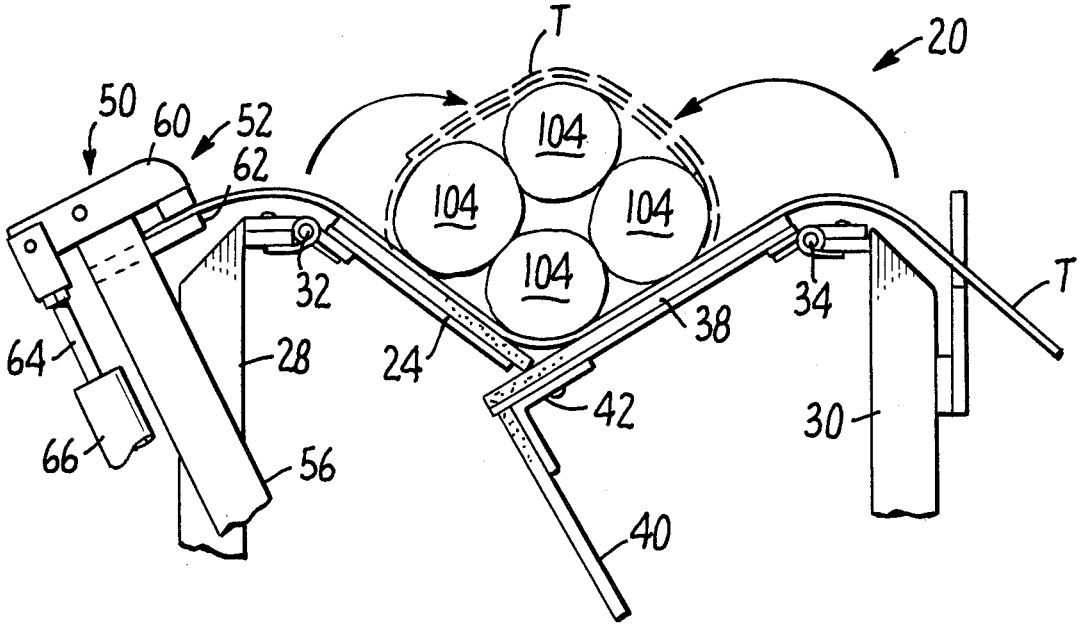
FIG. 3 is an enlarged side view illustrating details of the securing station of the present invention.

FIG. 3 provides the best illustration of the actual tape application step at the securing station. In that figure the operator has manually assembled a plurality of objects together which may, for example, be stalks 104 of broccoli. The operator consolidates the desired number of stalks or other objects by hand and positions them over the severed piece of adhesive tape resting upon flaps 24 and 26. He or she then pushes the bunch downwardly against the yieldable support surface defined by the flaps so that the flaps 24 and 26 pivot as shown in FIG. 3. When the objects pass through the flaps the spring loaded hinges operatively associated therewith keep the flaps in engagement with objects 104 and the tape. Because the flaps are constructed of yieldably flexible material they follow the outer upper periphery of the assembled objects as the flaps move back into position and the objects are passed through. In effect, the flaps "wipe" the adhesive tape about the group of objects being wrapped. The outer flap portion 40 maintains engagement with the tape and objects the longest period of time and causes the tape to overlap. The final configuration of the tape with respect to the objects 104 is shown in dotted lines in FIG. 3; however, it is to be understood that the tape is not completely wrapped around the objects while they are disposed over the flaps but after they have completely passed therethrough. Downward manual pressure on the objects and tape is sufficient to pull the tape from between jaw elements 60 and 62. After the objects have been taped they are manually disposed of and the operator repeats the operation with a new set of assembled objects.

I claim:

1. Apparatus for securing a plurality of objects together with an adhesive tape, comprising, in combination:

adhesive tape supply means including a roll of adhesive tape having a free end;

a securing station disposed adjacent to said tape supply means and including securing means for securing a predetermined length of tape about a plurality of objects positioned at said securing station, said securing station including yieldable flap means engageable by said plurality of objects and said tape, said yieldable flap means being operable to wrap said tape about said plurality of objects and to secure said tape thereto, said yieldable flap means including a first spring biased flap and a second spring biased flap, said flaps cooperating to provide support for said predetermined length of tape and yieldable when a plurality of objects is placed in engagement therewith to conform to the outer surface of said plurality of objects and press said predetermined length of tape into adhesive engagement therewith, said flaps being at least partially superposed with respect to one another to provide support for said predetermined length of tape, at least one of said flaps being generally L-shaped and including an outer flap portion which engages the tape and causes the tape to overlap when said objects are secured together;

delivery means for periodically delivering a predetermined length of tape to said securing station and including gripper means and prime mover means for moving said gripper means between a first position whereat said gripper means grips the free end of adhesive tape projecting from said roll of adhesive tape to a second position whereat a predetermined length of tape is positioned at said securing station; and separating means for separating said predetermined length of tape from said roll of adhesive tape prior to securing said predetermined length of tape about said plurality of objects.

* * * * *